US010161197B2

(12) United States Patent
Bell et al.

(10) Patent No.: US 10,161,197 B2
(45) Date of Patent: Dec. 25, 2018

(54) WELL TOOL CENTRALIZER SYSTEMS AND METHODS

(71) Applicants: William T. Bell, Huntsville, TX (US); James G. Rairigh, Houston, TX (US)

(72) Inventors: William T. Bell, Huntsville, TX (US); James G. Rairigh, Houston, TX (US)

( * ) Notice: Subject to any disclaimer, the term of this patent is extended or adjusted under 35 U.S.C. 154(b) by 0 days.

(21) Appl. No.: 14/664,544

(22) Filed: Mar. 20, 2015

(65) Prior Publication Data

US 2016/0273281 A1 Sep. 22, 2016

(51) Int. Cl.
*E21B 17/10* (2006.01)
*E21B 29/02* (2006.01)

(52) U.S. Cl.
CPC ..... *E21B 17/1078* (2013.01); *E21B 29/02* (2013.01)

(58) Field of Classification Search
CPC ..... E21B 17/1078; E21B 17/1021; E21B 17/1028; E21B 43/117
USPC ..... 166/381, 241.6, 241.7
See application file for complete search history.

(56) References Cited

U.S. PATENT DOCUMENTS 2,717,650 A 9/1955 Hall
2,797,756 A * 7/1957 Hall, Sr. ..... E21B 37/02 166/173
2,845,128 A 7/1958 Clark, Jr. et al.
3,053,182 A 9/1962 Christopher
3,196,951 A 7/1965 Sauerenman
3,599,567 A 8/1971 Graham et al.
3,619,844 A * 11/1971 Collins ..... B08B 9/0557 15/104.061
3,749,168 A 7/1973 Hall, Sr.
4,898,104 A 2/1990 Savoy et al.
4,961,381 A 10/1990 McLaughlin
5,046,563 A * 9/1991 Engel ..... E21B 29/02 102/310
5,600,863 A 2/1997 Curran
6,695,537 B2 2/2004 Spraggon
7,073,448 B2 7/2006 Bell
7,096,953 B2 * 8/2006 de Rouffignac ..... E21B 36/001 166/248
7,210,409 B2 5/2007 Johnson
2013/0299194 A1 * 11/2013 Bell ..... F42B 1/028 166/382

* cited by examiner

*Primary Examiner* — Matthew R Buck
*Assistant Examiner* — Patrick F Lambe

(57) ABSTRACT

An apparatus for, and method of, centering downhole well tools within the wellbore of a pipe comprises at least a pair of discs secured, respectively, to the distal end of a tool in a plane normal to a longitudinal tool axis, with an arc of each disc extended past the outer perimeter of the tool to at least an internal perimeter of an applied pipe bore and flexing to centralize the tool. In alternative embodiments, the discs are replaced by blades that are secured by a plurality of attachment points and fasteners, or by spring steel wires that are secured in radial apertures through an end boss by interference fit, soldering, swaging, or gluing.

24 Claims, 3 Drawing Sheets

WELL TOOL CENTRALIZER SYSTEMS AND METHODS

CROSS-REFERENCE TO RELATED APPLICATIONS

Not applicable.

FIELD OF THE INVENTION

The present invention relates to tools and methods for earth boring, well completion and production. More particularly, the invention relates to apparatus and methods for maintaining downhole tools approximately concentric with a pipe or tubing bore axis.

DESCRIPTION OF RELATED ART

In the process of well drilling, completion and production, there are numerous tools that require substantial centralization along the axis of a pipe or tube bore. In a frequently arising example, it becomes necessary to cut a pipe or tube at a point deep within a borehole. Such remote pipe cutting is often performed with a shaped charge of explosive.

Briefly, shaped charge explosives for pipe cutting generally comprise a disc of highly compressed explosive material, such as RDX or HMX, having a V-groove channel formed about the disc perimeter. A thin cladding of metal is intimately formed against the V-groove surface. When ignited at the center of the disc, the opposite flanks of the V-groove expansively explode against each other to produce a rapidly expanding jet of metal material where the impact of this jet material, upon the surrounding pipe or tubing wall, is to sever the pipe wall by hydrodynamically splashing the material out of the way.

Although reliable and effective when expertly applied, the radial cutting capacity of shaped charge cutters is usually limited to only a few inches from the perimeter of the explosive material disc. Moreover, this radial cutting capacity may be further limited by downhole fluid pressure. When detonated under a downhole fluid pressure of 18,000 psi, the cutting capacity of a shaped charge cutter may be reduced by as much as 40%. If the cutter alignment within the pipe is eccentric with the pipe axis, an incomplete cut may result.

Other examples of required axial position control for downhole tools include well measurement and logging processes, where the radial proximity of the pipe wall is influential upon the measured data.

As a functional method, well tool centralizers are known in the prior art. U.S. Pat. No. 7,073,448 to W. T. Bell describes a shaped charge cutter housing having a centralizer comprising four blades in a single plane attached by a single fastener at the distal end of the housing. U.S. Pat. No. 5,046,563 to W. T. Engel et al describes three flat springs formed into bows with one end of each attached to the end of a shaped charge cutter housing. U.S. Pat. No. 4,961,381 to P. D. McLaughlin describes a borehole centering device for blasthole primers comprising a plurality of thin, radially extending spikes secured to a central ring. The spikes are made of a semi-conducting plastic and the central ring is sized to fit over a primer case. A further example of centralizers is disclosed by S. T. Graham et al, in U.S. Pat. No. 3,599,567, including plastic wing members radiating from a drive point for attachment over the end of a stick of explosive. The wing members have the purpose of holding the buoyant explosive down as well as centralizing the charge within a shothole. The explosive casing cutter disclosure of U.S. Pat. No. 3,053,182, to G. B. Christopher, describes a plurality of backswept spring wires secured to the cutter housing in borings directed angularly to the tool axis. Clamping screws engage portions of the spring wires extending into the housing boring In adapting prior art centralizing devices to downhole tools, such as pipe and tubing cutters, difficulties arise in the form of excess material usage for forming multiple centering blades from a single sheet of spring steel. Centralizers with elaborate designs present fabrication/assembly difficulties.

One object of the present invention, therefore, is to provide the art with an inexpensively fabricated and easily attachable well tool centralizer.

SUMMARY OF THE INVENTION

One embodiment of the present invention comprises two or more thin, resilient metal discs attached to a tool housing end. Each disc is secured, preferably, by a single pin fastener through the disc center. The fastener is placed near the perimeter of the tool housing, whereby only an arcuate portion of a disc projects, substantially normally to the longitudinal tool axis, beyond the tool perimeter to engage a pipe or tubing inside wall surface.

In another invention embodiment, ends of thin, spring steel wires can be inserted into corresponding apertures in a base of the tool housing and secured by an interference fit or other securing methods. The interference fit may be obtained by swaging or by thermal shrinkage. In an alternative embodiment, the spring steel wires can be inserted into corresponding apertures of a base ring having a different diameter and, then, secured by such methods as interference fit. Alternatively, other securing methods may be used, including, but not limited to, soldering or gluing the spring steel wires directly to the base of the tool housing. Then, the secured spring steel wires can engage the inside of the wellbore during insertion/withdrawal of the tool.

In another invention embodiment, a plurality of thin, spring steel blades are attached via a plurality of fasteners to the end of the tool housing, the plurality of fasteners acting to prevent rotation of the centralizers during insertion/withdrawal of the tool, and the length of the blades cut to ensure contact with (and thus centralization relative to) the wellbore.

BRIEF DESCRIPTION OF THE DRAWINGS

The invention is hereafter described in detail and with reference to the drawings wherein like reference characters designate like or similar elements throughout the several figures and views that collectively comprise the drawings. Respective to each drawing figure.

DESCRIPTION OF THE PREFERRED EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
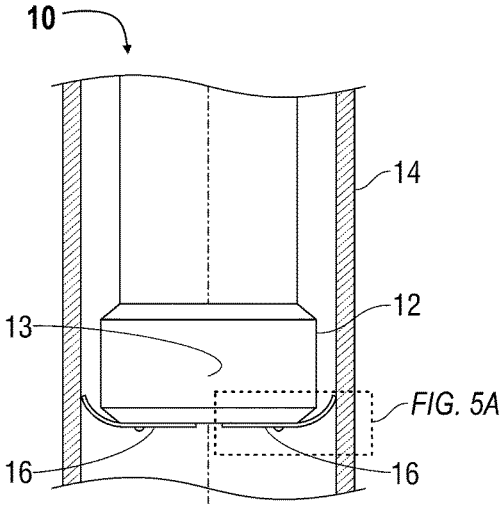
FIG. 1 is a longitudinal section of pipe enclosing a shaped charge pipe cutting tool fitted with one embodiment of the present invention.
Figure 2:
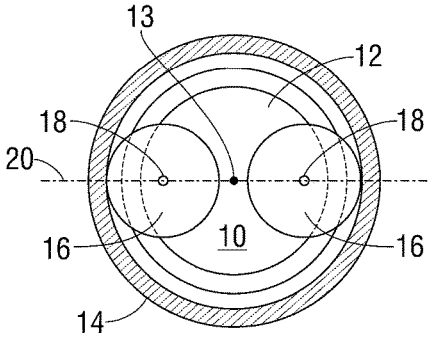
FIG. 2 is a cross section of the FIG. 1 illustration showing a plan view of an embodiment of the invention.

With respect to FIGS. 1 and 2, a special case of the invention is shown as to include a tubing cutter 10 having explosives (not shown) within a housing 12. The cutter 10 is shown as located within a downhole tube 14. The cutter 10 is centrally confined within the tube 14 by a pair of centralizing discs 16 having a substantially circular planform.

As best shown by FIG. 2, the centralizing discs 16 are secured to the cutter housing 12 by anchor pin fasteners 18, shown in this embodiment as screws. The disc plane is substantially normally oriented to the housing axis 13. Since the discs 16 are not expected to rotate about the anchor pins 18, swage rivets may also serve for securing the discs to the housing 12.

In the FIGS. 1 and 2 embodiment, the discs are mounted along a diameter line 20 across the cutter housing 12, with the most distant points on the disc perimeters separated by a dimension that is preferably at least corresponding to the inside diameter of the tubing 14. In many cases, however, it will be desirable to have a disc perimeter separation slightly greater than the internal diameter of the tubing 14. This configuration is illustrated by the upward sweep in the discs in contact with the tubing 14 inside wall.

Attention is particularly directed to the geometric consequence of two, relatively small diameter discs 16 secured on the diametric centerline of a larger diameter circle with opposite extreme locus points of the disc 16 perimeter coinciding with diagonally opposite locus points on the larger circle perimeter. Any force on the tool housing 12 substantially normal to the diameter 20 can be opposed by a wedging reaction against the inside wall curvature of the tube 14. This wedging reaction can be applied to the disc 16 perimeters and, ultimately, to the housing 12 by the mounting pins 18 to maintain the axial center of the housing 12 in directions transverse to the diameter 20.

Figure 4:
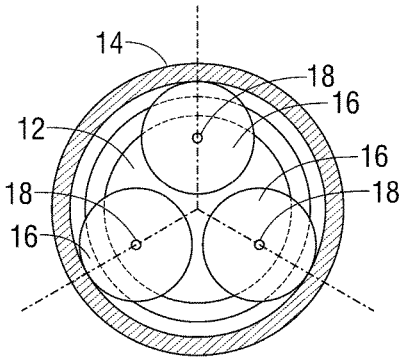
FIG. 4 is a plan view of an alternative configuration of the invention.

In another embodiment of the invention as shown by FIG. 4, three discs 16 are secured by pin fasteners 18 to the housing at approximately 120° arcuate spacing about the housing axis 13 (shown in FIG. 2). In this embodiment, the most distant elements of the disc 16 perimeters from the housing axis 13 at least coincide with the inside perimeter locus of the tubing 14.

The FIG. 4 embodiment is representative of applications for a multiplicity of centering discs on a tool housing 12. Depending on the relative sizes of the tool 10 and pipe 14, there may be three or more such discs distributed at substantially uniform arcs about the tool circumference.

Regarding the disc 16 properties, the terms "thin", "resilient" and "metallic" are used herein to generally describe gage thickness of high carbon and heat treated "spring" steels. Although other metal alloys are functionally suitable, the parameter of economics is a strong driver of the invention, and exotic alloys are relatively expensive.

Figure 5A:
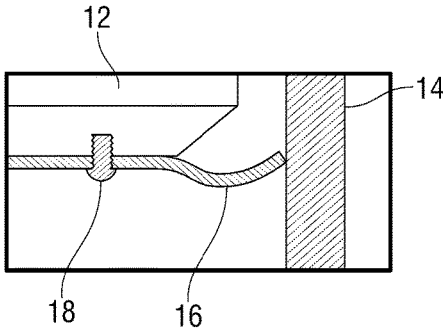
FIG. 5A is an operative detail of an embodiment of the invention in a tool withdrawal mode.

Within this triad of material properties for a specific disc 16 application, gage thickness and bending modulus are paramount for the reason best illustrated by FIG. 5A. In the event a well tool 10 must be withdrawn from a downhole location, the projecting arc of the disc 16 can be compressively deformed to reverse the drag sweep against the tubing wall. If the tool 10 is suspended in the tube 14 by the use of a wireline or slick line, not shown, potential exists for exceeding the tensile strength of the support line. A well tool supported by a tubing or pipe string is not as limited. Nevertheless, the disc 16 design limitations of "thin" and "resilient" have particular meaning for specific applications of the invention.

Figure 5B:
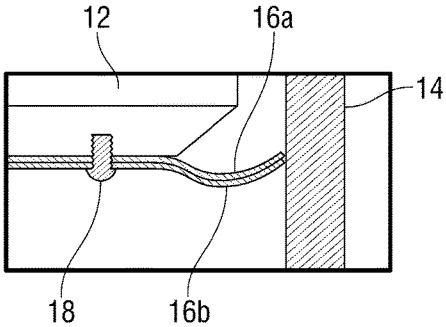
FIG. 5B is an operative detail of an alternative embodiment of the invention in withdrawal mode.

Furthermore, as illustrated in FIG. 5B, such designs have advantages in that they can be provided in a "stack" configuration, illustrated here as a pair of discs, 16*a* and 16*b*, each having a thickness less than the thickness of the disc 16 illustrated in FIG. 5A. Such configurations, it has been discovered, provide centralizing force nearly equivalent to a single disc thickness while reducing the force required to insert or withdraw the tool 10 from the tube 14, due to the reduction in compressive stress along the diameter of the discs 16*a*, 16*b*.

Figure 3:
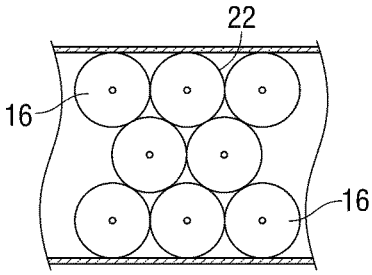
FIG. 3 is a sheet metal die cutting pattern for centralizing discs, illustrating the material utilization efficiency of this invention.

While the centralizing force created by the arcuate projection of discs 16 beyond the tool housing 12 perimeter is an operative element of the invention, the economics of fabrication is an equally driving feature. Configurations other than a full circle may also provide an arcuate projection from the tool 12 perimeter. However, many alternate configurations are either more expensive to form or waste more fabrication material. Shown by FIG. 3 is a disc 16 stamping pattern as imposed against a stock sheet of thin, resilient metal material 22. When compared to single plane cross or star pattern centralizers, the percentage of material waste for a disc pattern is minimal.

Figure 6:
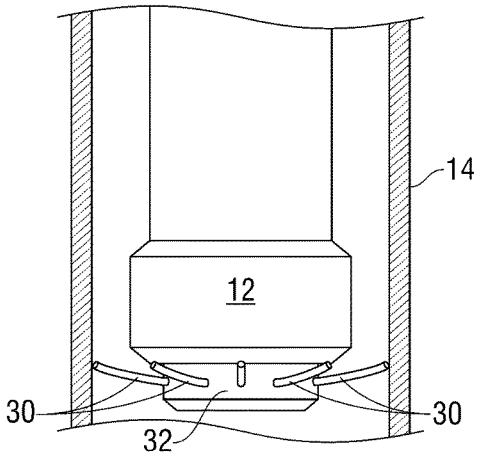
FIG. 6 is a partially sectioned elevation showing an alternative embodiment of the invention.

Referring now to FIG. 6, another economically driven embodiment of the invention is illustrated which includes spring steel centralizing wires 30 of small gage diameter. A plurality of these wires are arranged radially from an end boss 32, seated within and extending from apertures 34 (shown in FIGS. 8A-8B). Such wires may preferably be formed of high-carbon steel, stainless steel, or any metallic or metallic composite material with sufficient flexibility and tensile strength.

The end boss 32 is machined as an integrated part of the tool housing 12, and the diameter of the end boss 32 will always be smaller than the diameter of the tool housing 12. Note that the scale and angle of end boss 32 is depicted for clarity; in alternative embodiments, end boss 32 may be any configuration of the distal end of tool housing 12.

Figure 7:
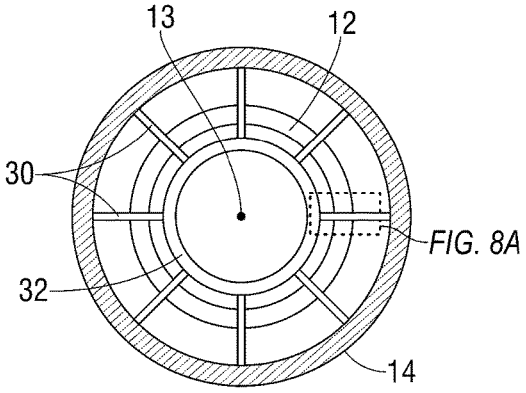
FIG. 7 is a plan view of the FIG. 6 invention embodiment.

Referring now to FIG. 7, a plan view of the configuration in FIG. 6 is shown, with the plurality of centralizing wires 30 projecting outwardly in a radial arrangement from end boss 32. While the depicted configuration includes a total of eight centralizing wires 30, it should be appreciated that the plurality may be made up of any number of centralizing wires 30, or in some cases, as few as two. As can be seen in the plan view, the use of centralizing wires 30 rather than blades or other machined pieces, allows for the advantageous maximization of space in the flowbore around the centralizing system, compared to previous spider-type centralizers, by minimizing the cross-section compared to systems featuring flat blades or other planar configurations.

As with the configuration in FIGS. 1-5, the wires 30 are normally oriented to the housing axis 13 and engaged with the sides of the tubing 14. Wires 30 are sized such that the length of the wires 30 is slightly larger than the length between the inside terminus of apertures 34 and inside diameter of tubing 14. Thus, wires 30 will exert compressive force to centralize tubing cutter 10, and flex in the same fashion as the cross-section of discs 16, shown in FIG. 1 and FIG. 5*a*, during insertion and withdrawal. The length of wires 30 may be sized for a specific tubing 14 inside diameter, either before or after attachment to the end boss 32.

Figure 8A:
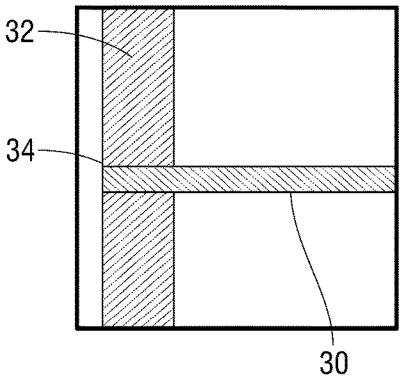
FIG. 8A is an enlarged cross-section of one method of fitting the wires of the embodiment of FIG. 6.

Referring now to FIG. 8A, the system of FIGS. 6-7 is shown in cross-section, including the end boss 32 having the plurality of apertures 34 formed laterally and penetrating a short distance therein 32. Apertures 34 are sized to accommodate the diameter of the wires 30 at the surface of the end boss, which are attached within the apertures 34 via glue, soldering, or other methods.

Figure 8B:
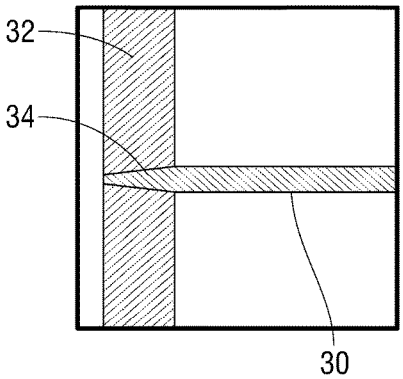
FIG. 8B is an enlarged cross-section detail of another method of fitting the wires of the embodiment of FIG. 6.

Referring now to FIG. 8B, an alternative attachment method is shown for the FIG. 6-7 embodiment, in which the diameter of the aperture 34 is slightly smaller than the body of the wires 30, which enables an interference fit, or press fit, between wires 30 and aperture 34, where the proximal ends of wires 30 are inserted into the apertures, and then subjected to compressive force and deformed slightly to fit the narrower aperture 34.

Figure 9:
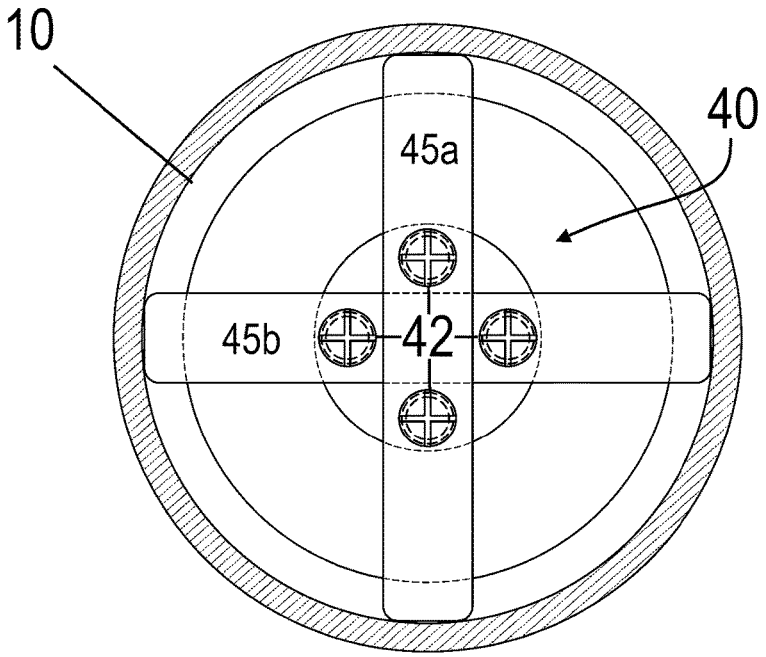
FIG. 9 depicts an alternative embodiment of the present invention comprising a plurality of planar, finger-like structures usable for centralizing a tubing cutter.

Referring now to FIG. 9, a third embodiment of the invention is illustrated herein. This configuration comprises a plurality of planar, finger-like structures (herein "blades") to centralize a tubing cutter 10. The plurality 40 of blades 45*a*, 45*b* are positioned on the bottom surface of the tubing cutter 10 through a plurality of fasteners 42, projecting outwardly therefrom. The plurality 40 of blades 45*a*, 45*b* thus flex, against the sides of the wellbore 14, to exert a centralizing force in substantially the same fashion as the disc embodiments depicted in FIGS. 1 and 5A-5B. Thus, it can be appreciated that the plurality 40 of blades 45*a*, 45*b* may also comprise a stacked embodiment in which the thickness is reduced to stack multiple blades 45 on the same plurality of fasteners 42.

Figure 10:
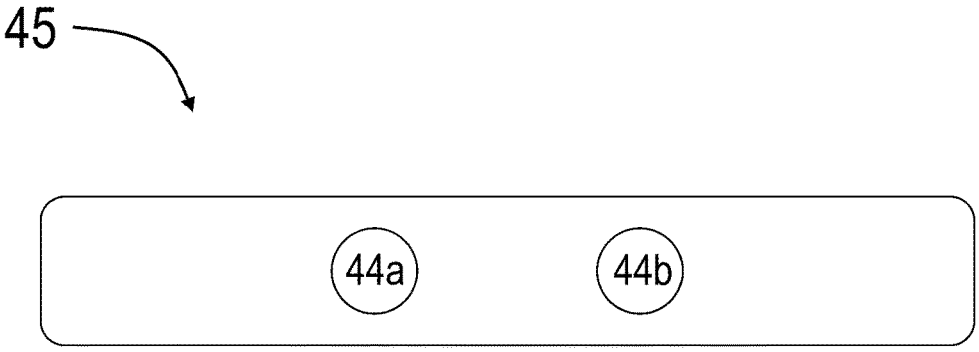
FIG. 10 depicts an embodiment of a single blade, from the plurality of blades, for use in centralizing a tubing cutter.

FIG. 10 depicts an embodiment of a single blade 45 from the plurality of blades 40. Each blade 45 comprises a plurality of attachment points 44*a*, 44*b*, through which fasteners 42 secure the blade in position. As shown, each respective fastener can extend through a respective attachment point to secure the blade into position. While the embodiment in FIG. 9 is depicted with two blades 45*a*, 45*b*, and each blade 45 comprising two attachment points, for a total of four fasteners 42 and four attachment points (44*a*, 44*b* are pictured in FIG. 10), it should be appreciated that the invention may comprise any number of fasteners and attachment points.

Significantly, the multiple attachment points 44 on each blade, being spaced laterally from each other, prevent the unintentional rotation of individual blades 45, even in the event that the fasteners 42 are slightly loose from the attachment points 44. The fasteners 42 can be of any type of fastener usable for securing the blades into position, including screws.

Each blade 45 of the plurality 40 of blades 45 can be manufactured at a low cost from a pre-selected width of coil material and simply cut for length, obviating the need in the prior art for specially designed and cut centralizer patterns. As set forth above, the plurality of blades can be spaced laterally and oriented perpendicular to each other, for centralizing a tubing cutter 10 and preventing unintentional rotation of the one or more blades 45.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A well tool, wherein said well tool comprises:

a cylindrical housing configured for suspension within a downhole pipe bore, wherein the cylindrical housing comprises a distal end formed with a planar surface normal to a longitudinal axis of the well tool; and a plurality of metal elements secured to the planar surface of the distal end, each respective metal element of the plurality of metal elements secured with a respective fastener of a plurality of fasteners, wherein the plurality of metal elements are fabricated from a gage thickness of spring steel, and form a plane aligned parallel to the planar surface of the distal end at least to an external perimeter of the cylindrical housing, and wherein each of the plurality of metal elements comprises an arcuate perimeter extending, at least in part, along the plane and past the external perimeter of the cylindrical housing.

2. The well tool as described by claim 1, wherein each of the plurality of metal elements comprises a circular planform.

3. The well tool as described by claim 1, wherein each of the plurality of metal elements comprise one or more discs secured to the cylindrical housing proximate of a center of said one or more discs at respective locations on the planar surface of the distal end.

4. The well tool as described by claim 3, wherein each of the plurality of metal elements comprises at least two discs of the one or more discs in stacked alignment.

5. The well tool as described by claim 3, wherein each fastener of the plurality of fasteners comprises a pin fastener extending through the center of said one or more discs into the planar surface of the distal end.

6. The well tool as described by claim 3, wherein a plurality of the metal elements are secured to the cylindrical housing at uniform arcuate positions about the longitudinal axis of the well tool.

7. The well tool as described by claim 1, wherein the well tool is suspended in a downhole pipe bore.

8. The well tool as described by claim 5, wherein the metal elements are separated along a housing diameter.

9. The well tool as described by claim 8, wherein the opposite arcuate perimeters of the pair of the plurality of metal elements are positioned along an inside perimeter locus of a downhole pipe bore.

10. A shaped charge pipe cutter comprising:

a cylindrical housing for enclosing a shaped explosive charge, wherein the cylindrical housing comprises planar surface portions of a distal end formed normal to an axis of the cylindrical housing; and a plurality of metal centering elements, each respective metal centering element of the plurality of metal centering elements secured to said housing by a respective fastener of a plurality of fasteners, wherein the plurality of metal centering elements forms a plane parallel to the planar surface portions of the distal end at least to an outer perimeter of the cylindrical housing, wherein each of the plurality of metal centering elements comprises an arcuate perimeter projecting, at least in part, along the plane and past the outer perimeter of the cylindrical housing, and wherein the projections of the respective arcuate perimeters of the plurality of metal centering elements are aligned within an internal perimeter of a pipe intended for severance.

11. The shaped charge pipe cutter as described by claim 10, wherein each of the plurality of metal centering elements comprises a circular planform.

12. The shaped charge pipe cutter as described by claim 11, wherein the plurality of metal centering elements comprises at least one disc secured to the respective planar surface portions of the distal end proximate to a center of each disc.

13. The shaped charge pipe cutter as described by claim 12, wherein each metal centering element comprises at least two discs in stacked alignment.

14. The shaped charge pipe cutter as described by claim 13, wherein each of the plurality of metal centering elements is secured to the cylindrical housing by a pin fastener extending through the center of the at least two discs into the cylindrical housing.

15. The shaped charge pipe cutter as described by claim 12, wherein the metal centering elements are fabricated from a gage thickness of spring steel.

16. The shaped charge pipe cutter as described by claim 12, wherein the plurality of metal centering elements are secured to respective planar surface portions with a plurality of pin fasteners, wherein the plurality of pin fasteners are separated along a housing diameter.

17. The shaped charge pipe cutter as described by claim 16, wherein the projections of the pair of the plurality of metal centering elements are positioned at least along an inside perimeter of a downhole pipe bore.

18. The shaped charge pipe cutter as described by claim 11, wherein the plurality of metal centering elements are secured to the distal end of the housing at uniform arcuate positions about the axis of the housing.

19. A method of centering a well tool within a pipe bore, comprising:

fabricating a plurality of metal discs from a gage thickness of spring steel, each of the plurality of metal discs having a diameter less than half of the diameter of a cylindrical well tool;

attaching each of the plurality of metal discs to a distal end of the cylindrical well tool with a plurality of fasteners, each metal disc of the plurality of metal discs corresponding to a fastener of the plurality of fasteners, in a plane substantially normal to an axis of the cylindrical well tool and parallel to the distal end of the cylindrical well tool at least to an outer perimeter of the well tool, such that an arcuate portion of the perimeter of each of the plurality of metal discs extends along the plane past the outer perimeter of the well tool; and suspending the well tool in a downhole pipe bore, such that the arcuate portion of the perimeter of each of the plurality of metal discs contacts an inner perimeter of the pipe bore and exerts a centering force towards the axis of the cylindrical well tool.

20. The method of claim 19, wherein the step of attaching each of the plurality of metal discs to a distal end of the cylindrical well tool additionally comprises attaching at least a pair of the plurality of metal discs along a diameter of the cylindrical well tool.

21. A system for centralizing a downhole tool within a wellbore comprising:

a projection from a distal end of the downhole tool; and a plurality of overlapping blades secured to the distal end of the downhole tool, wherein each blade of the plurality of overlapping blades is secured to the projection by a plurality of fasteners, wherein the plurality of fasteners prevent rotation of the plurality of overlapping blades, and wherein the plurality of overlapping blades are of sufficient length to engage with the inside of the wellbore.

22. The system of claim 21, wherein the plurality of fasteners securing the plurality of overlapping blades to the projection constitute screws.

23. The system of claim 21, wherein the plurality of overlapping blades are oriented perpendicular to each other.

24. The system of claim 21, wherein each blade of the plurality of overlapping blades comprises a plurality of attachment points, and wherein each respective fastener extends through a respective attachment point for securing the blade into position.

* * * * *